US006364132B1

(12) United States Patent
Feng

(10) Patent No.: US 6,364,132 B1
(45) Date of Patent: Apr. 2, 2002

(54) BOOKSHELF STRUCTURE

(76) Inventor: Yuan Feng Feng, No. 197, Sec. 2, Jungching Rd., Dayard, Taichung County (TW)

( * ) Notice: Subject to any disclaimer, the term of this patent is extended or adjusted under 35 U.S.C. 154(b) by 0 days.

(21) Appl. No.: 09/687,975

(22) Filed: Oct. 13, 2000

(51) Int. Cl.[7] ..... A47B 65/00

(52) U.S. Cl. ..... 211/43; 211/184; 248/441.1

(58) Field of Search ..... 211/43, 42, 153, 211/90.01, 90.02, 184, 59.3, 59.4, 86.01, 94.01, 175; 248/441.1, 448; 108/61

(56) References Cited

U.S. PATENT DOCUMENTS 1,363,138 A * 12/1920 Markham ..... 211/43
1,506,204 A * 8/1924 Snoddy ..... 211/43
1,875,288 A * 8/1932 Welk et al. ..... 248/441.1
2,134,606 A * 10/1938 Hackworth et al. ..... 211/43
2,620,929 A * 12/1952 Sportsman ..... 211/43
3,391,793 A * 7/1968 Streuli ..... 211/43
4,099,624 A * 7/1978 McKearin ..... 211/42
4,162,013 A * 7/1979 Tucker ..... 211/43
5,228,578 A * 7/1993 Wu ..... 211/43
5,415,297 A * 5/1995 Klein et al. ..... 108/61
5,449,076 A * 9/1995 Van Noord ..... 211/59.3
5,762,208 A * 6/1998 Yeh ..... 211/43
5,765,697 A * 6/1998 Soong ..... 211/43

* cited by examiner

*Primary Examiner*—Daniel P. Stodola
*Assistant Examiner*—Jennifer E. Novosad
(74) *Attorney, Agent, or Firm*—Pro-Techtor International Services

(57) ABSTRACT

A bookshelf including a pair of side plates, a back plate, and a bottom plate being spaced from the back plate by a transverse opening and one or more sliding dividers each including a substantially L-shaped attachment member. The back plate is at a predetermined angle with respect to a vertical axis, the bottom plate is at the same predetermined angle with respect to a vertical axis.

1 Claim, 6 Drawing Sheets

BOOKSHELF STRUCTURE

FIELD OF THE INVENTION

The present invention relates to a detachable bookshelf with improved characteristics.

BACKGROUND OF THE INVENTION

It is often messy when many books are placed on a conventional bookshelf. This condition is not improved even when a number of dividers are provided therein. Further, the bottom plates of all conventional bookshelves are horizontally disposed. As such, a person is usually required to bend his/her back to find the desired books. This is quite inconvenient.

Thus, it is desirable to provide an improved bookshelf in order to overcome the above drawbacks of prior art.

SUMMARY OF THE INVENTION

It is an object of the present invention to provide a detachable bookshelf comprising a pair of side plates, a back plate, a bottom plate being spaced from the back plate by a transverse opening, and one or more sliding dividers each including a substantially L-shaped attachment member. The back plate is at a predetermined angle with respect to axis of ordinate and the bottom plate is at the same predetermined angle with respect to axis of abscissa. People can easily find the desired books on the bookshelf.

In one aspect of the present invention, each attachment member comprises a substantially L-shaped corner member and two integrally formed substantially L-shaped end members slidingly engaged with the back plate and the bottom plate respectively.

The above and other objects, features and advantages of the present invention will become apparent from the following detailed description taken with the accompanying drawings.

DETAILED DESCRIPTION OF THE PREFERRED EMBODIMENTS

Referring to FIGS. 1 to 5, there is shown a bookshelf constructed in accordance with the invention comprising a pair of side plates 10, a back plate 11, a bottom plate 12, and a divider 13. This bookshelf is generally formed of wood. Also, the bookshelf is detachable. Detail of each component is described below.

Figure 1:
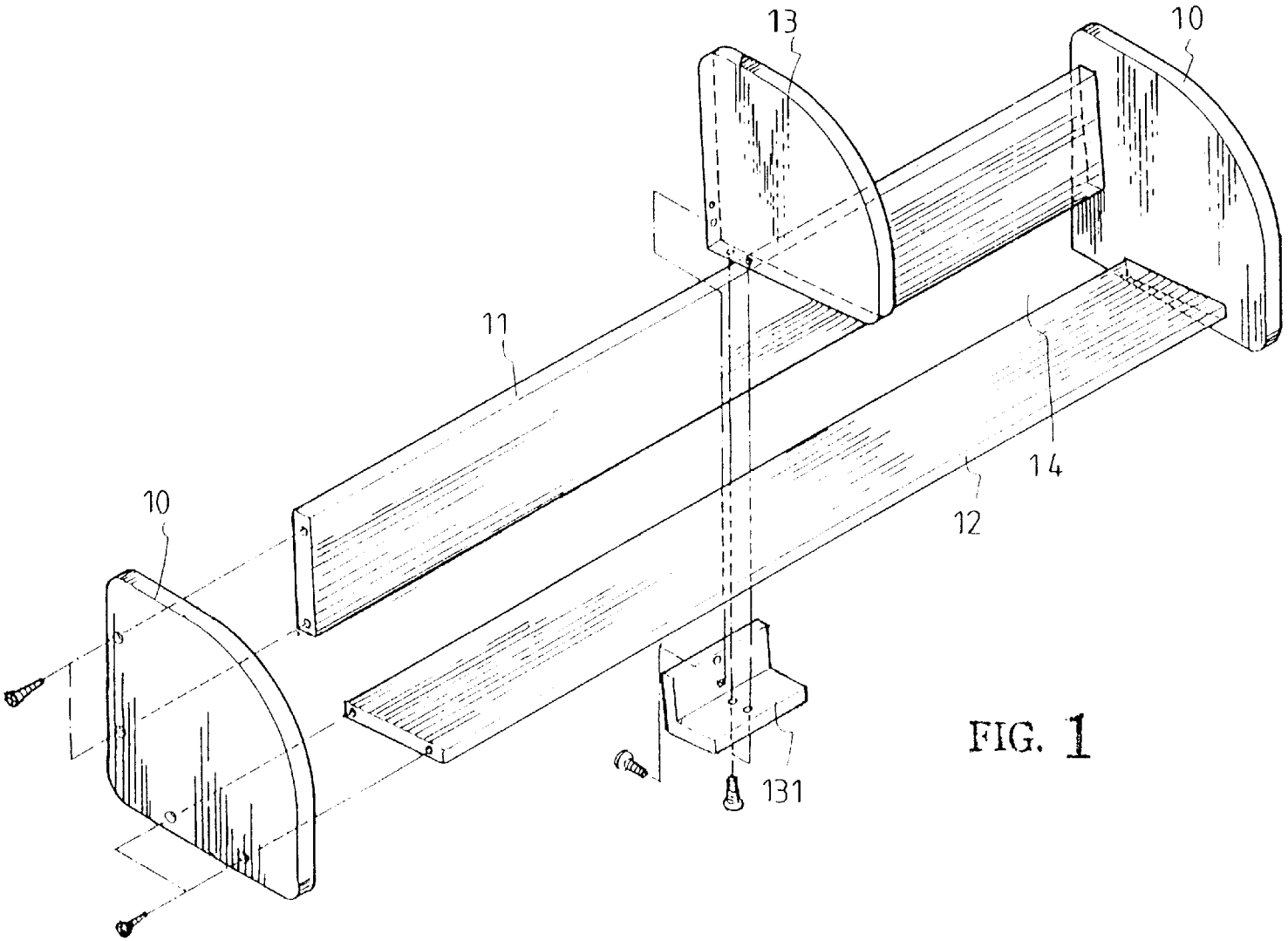
FIG. 1 is an exploded view of a first preferred embodiment of bookshelf according to the invention.
Figure 2:
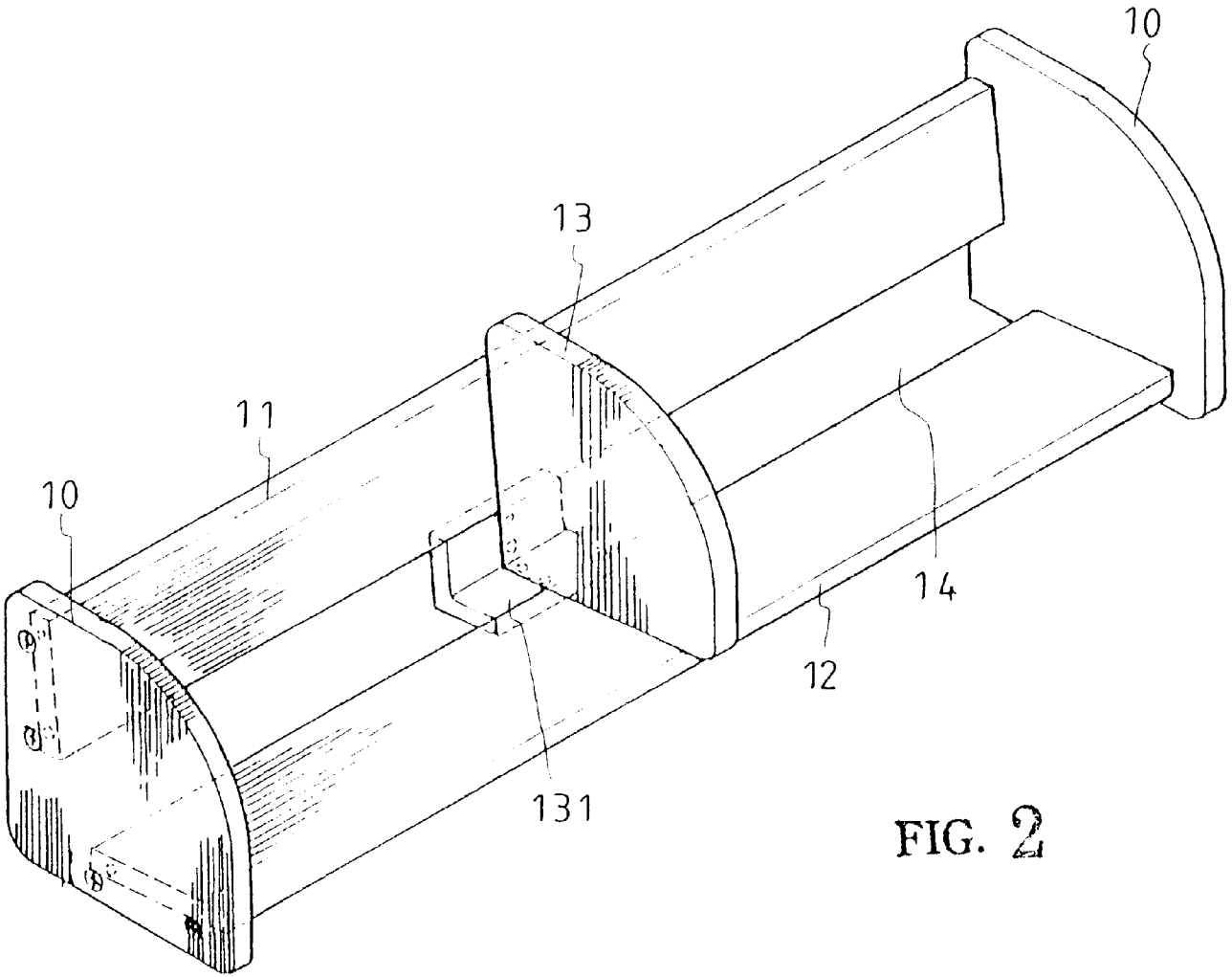
FIG. 2 is a perspective view of the assembled FIG. 1 bookshelf.
Figure 3:
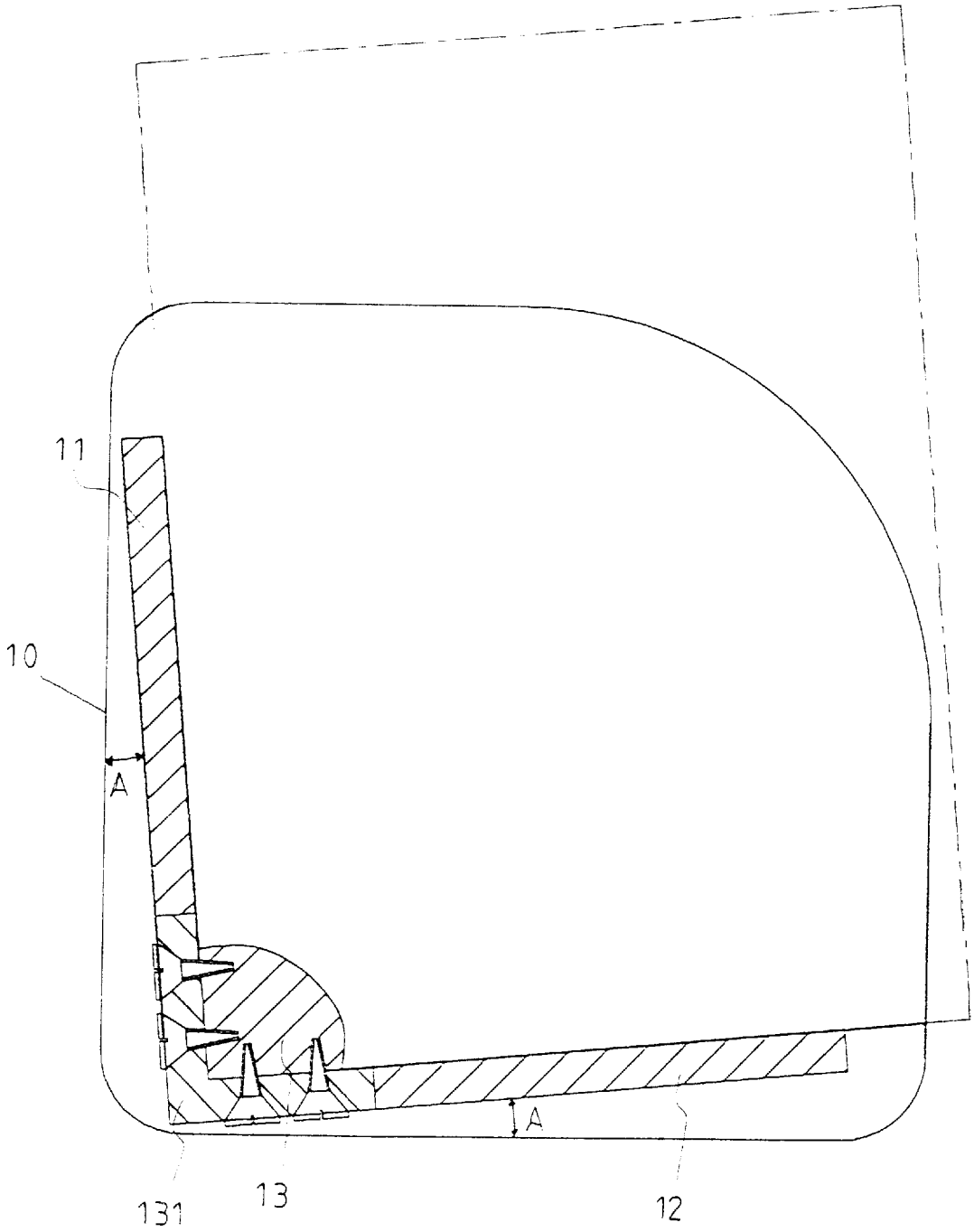
FIG. 3 is a schematic cross-sectional view of FIG. 2 showing the inclined bottom and back plates of bookshelf.
Figure 4:
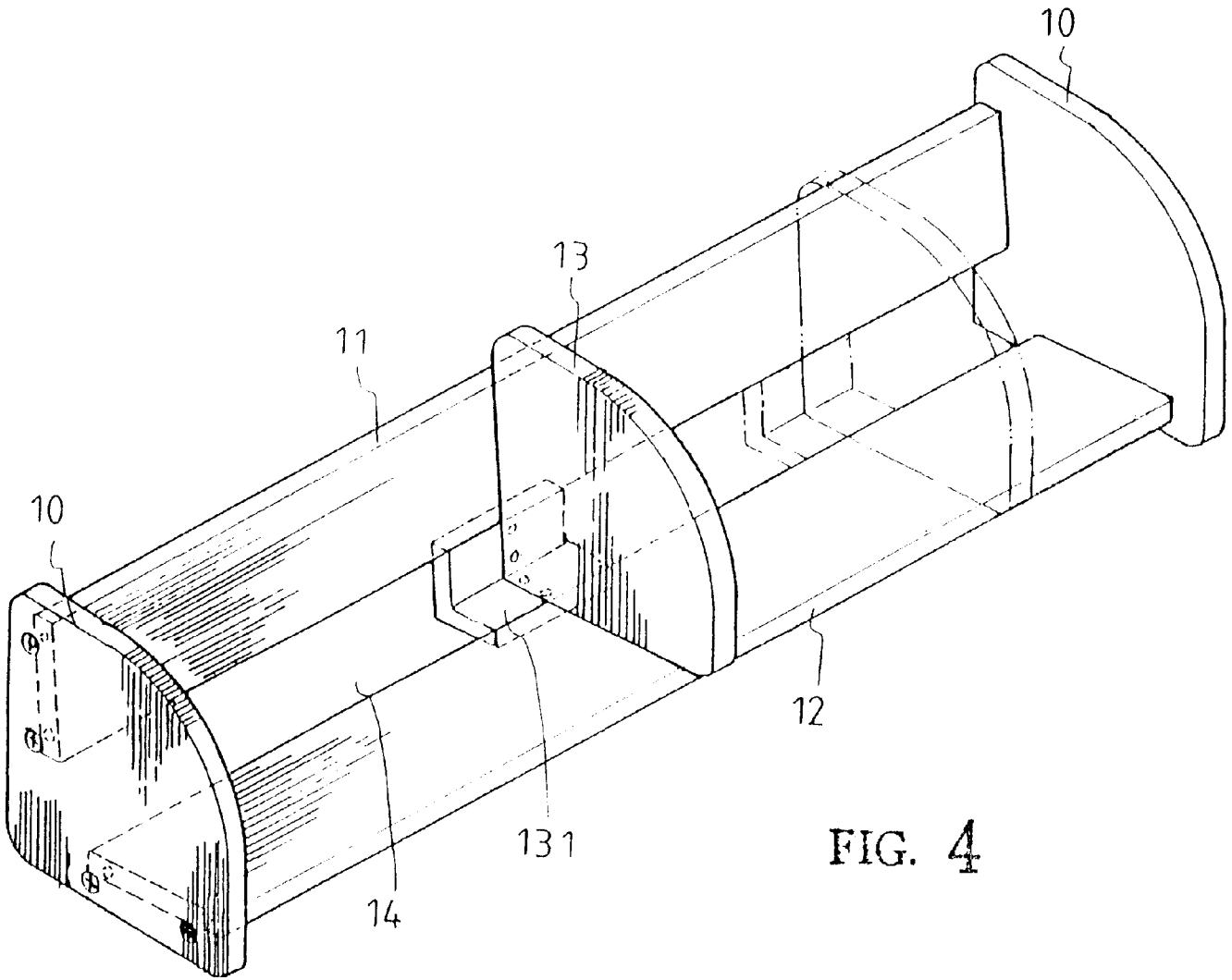
FIG. 4 is a view similar to FIG. 2 showing the sliding feature of divider.
Figure 5:
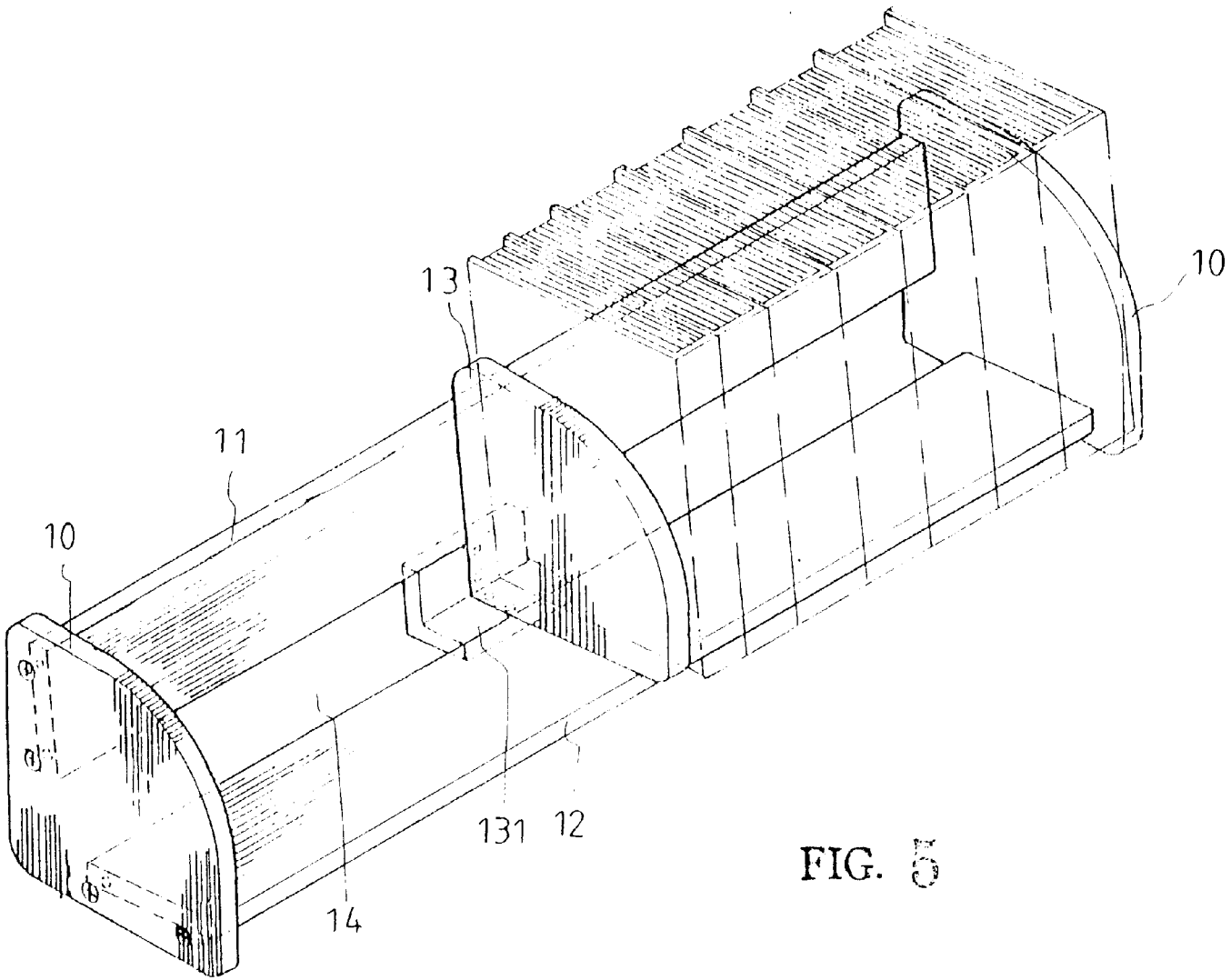
FIG. 5 is an environmental view of the FIG. 2 bookshelf.

Back plate 11 is at an angle A with respect to axis of ordinate, while bottom plate 12 is at the same angle A with respect to axis of abscissa. In other words, back plate 11 is perpendicular to bottom plate 12. This is a convenient design for people to find the desired books. A transverse opening 14 is formed between back plate 11 and bottom plate 12. A substantially L-shaped attachment member 131 is threadedly secured to divider 13 by means of fasteners (e.g., screws). The assembled attachment member 131 and divider 13 is capable of sliding between the space defined by side plates 10 (see FIG. 4). Further, the sliding divider 13 is capable of holding a number of books firmly in place as shown in FIG. 5. It is appreciated by those skilled in the art that the number of divider 13 may be more than one. Also, divider 13 and attachment member 131 may be formed integrally when a mass production of bookshelf is desired.

Figure 6:
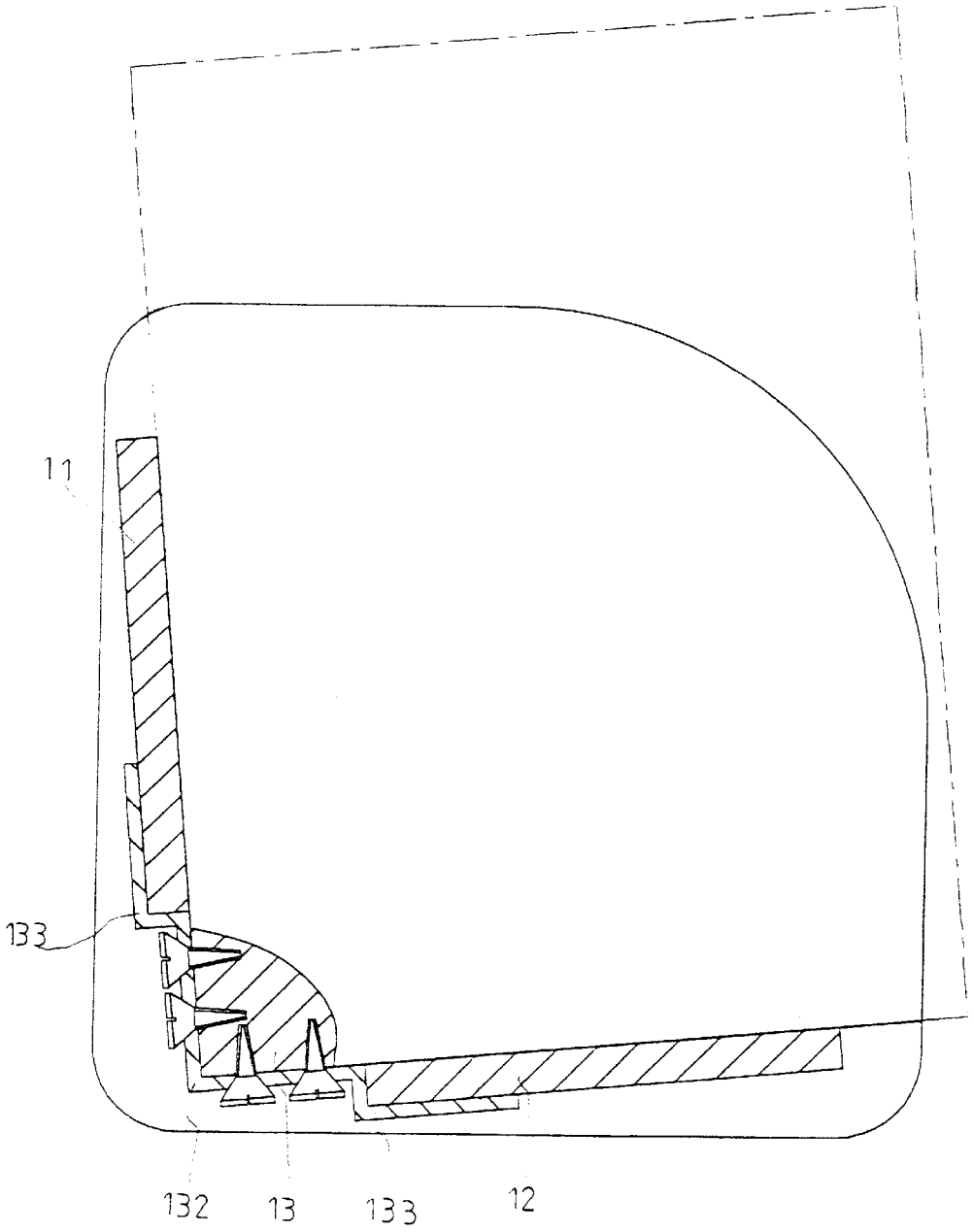
FIG. 6 is a schematic cross-sectional view illustrating a second preferred embodiment of divider of bookshelf according to the invention.

Referring to FIG. 6, there is shown a second preferred embodiment of divider 13 of bookshelf according to the invention. As shown, attachment member is substantially a stepped structure in either side. In detail, attachment member comprises a substantially L-shaped corner member 132 for supporting books and two substantially L-shaped end members 133 for slidingly engaged with back plate 11 and bottom plate 12 respectively. Preferably, corner member 132 and end members 133 are integrally formed.

While the invention has been described by means of specific embodiments, numerous modifications and variations could be made thereto by those skilled in the art without departing from the scope and spirit of the invention set forth in the claims.

What is claimed is:

1. The bookshelf comprising:

a pair of side plates;

a back plate;

a bottom plate spaced from said back plate by a transverse opening; and at least one sliding divider, said at least one sliding divider including an attachment member, said attachment member comprises a substantially L-shaped corner member and two integrally formed substantially L-shaped end members slidingly engaged with said back plate and said bottom plate respectively; wherein said back plate is positioned at a first angle with respect to a vertical axis, and said bottom plate is positioned at a second equal angle with respect to a horizontal axis, whereby said second angle is equal to said first angle.

* * * * *